US005623827A

United States Patent [19]

Monty

[11] Patent Number: 5,623,827

[45] Date of Patent: Apr. 29, 1997

[54] REGENERATIVE COOLED DOME ASSEMBLY FOR A GAS TURBINE ENGINE COMBUSTOR

[75] Inventor: Joseph D. Monty, Boxford, Mass.

[73] Assignee: General Electric Company, Cincinnati, Ohio

[21] Appl. No.: 378,703

[22] Filed: Jan. 26, 1995

[51] Int. Cl.[6] ..... F23R 3/60

[52] U.S. Cl. ..... 60/748; 60/39.36; 60/747

[58] Field of Search ..... 60/757, 756, 746, 60/797, 39.36, 39.32, 748, 39.83; 244/110 B; 239/405

[56] References Cited

U.S. PATENT DOCUMENTS

| | | | |
|---|---|---|---|
| 3,946,552 | 3/1976 | Weinstein et al. | 60/39.74 R |
| 4,070,826 | 1/1978 | Stenger et al. | 60/39.66 |
| 4,180,974 | 1/1980 | Stenger et al. | 60/39.71 |
| 4,236,378 | 12/1980 | Vogt | 60/757 |
| 4,260,367 | 4/1981 | Markowski et al. | 431/353 |
| 4,561,257 | 12/1985 | Kwan et al. | 60/737 |
| 4,606,190 | 8/1986 | Greene et al. | 60/39.23 |
| 4,754,600 | 7/1988 | Barbier et al. | 60/748 |
| 4,974,416 | 12/1990 | Taylor | 60/737 |
| 5,123,248 | 6/1992 | Monty et al. | 60/748 |
| 5,197,278 | 3/1993 | Sabla et al. | 60/39.02 |
| 5,197,289 | 3/1993 | Glevicky et al. | 60/746 |
| 5,253,471 | 10/1993 | Richardson | 60/39.36 |
| 5,321,951 | 6/1994 | Falls et al. | 60/748 |
| 5,328,761 | 7/1994 | Ablett et al. | 60/39.36 |

*Primary Examiner*—Charles G. Freay

*Attorney, Agent, or Firm*—Andrew C. Hess; Patrick R. Scanlon

[57] ABSTRACT

A dome assembly for a single annular combustor of a gas turbine engine is disclosed as having a first dome wall in flow communication with compressed air supplied to the combustor, the first dome wall including a central opening therein and at least one cooling passage therethrough. A baffle is spaced downstream of and connected to the first dome wall at radially outward and inward ends, the baffle also including a central opening therein. A second dome wall defining the central opening in the first dome wall is provided which extends upstream of the first dome wall. A venturi is located within the central opening of the first dome wall, with the venturi including a flange extending radially outward from the central opening, wherein the second dome wall is connected to the flange at an upstream end. A flare cone is located within the central opening of the baffle and radially outward of the venturi, wherein a substantially radial passage is provided between the venturi flange and the flare cone, the radial passage having a swirler located therein. Accordingly, a chamber is formed by the first dome wall, the second dome wall, the baffle, the venturi, and the flare cone, the chamber being in flow communication with the compressed air entering the combustor by means of the cooling passage in the first dome wall, whereby the compressed air impinges on the baffle, circulates in the chamber, and exits through the swirler. In addition, a circumferential row of cooling passages is preferably located in the baffle adjacent the flare cone and rows of cooling passages are also located at both the radially outward and inward ends of the baffle.

20 Claims, 6 Drawing Sheets

REGENERATIVE COOLED DOME ASSEMBLY FOR A GAS TURBINE ENGINE COMBUSTOR

BACKGROUND OF THE INVENTION

1. Field of the Invention

The present invention relates to a combustor for a gas turbine engine, and, more particularly, to a dome assembly for a gas turbine engine combustor which regenerates spent cooling air into the combustion process.

2. Description of Related Art

An important goal in the current design of gas turbine engine combustors is the reduction of emissions in the form of carbon monoxide, unburned hydrocarbons, and oxides of nitrogen. Fundamental to such designs is the thorough premixing of fuel and air, as well as the burning of such premixture at lean fuel/air ratios. At the same time, a certain amount of cooling air is required in order to maintain combustor liner temperatures, as well as to protect the dome of the combustor. In order to provide this required cooling, the conventional strategy has been to segregate the cooling air from the combustion air, which thereby builds in fundamental inhomogenieties in fuel/air distribution.

As seen in U.S. Pat. No. 4,180,974 to Stenger, et al., a series of heat shield plates or baffles are utilized to protect the dome structure from direct radiant heat load. These plates or baffles are conventionally cooled by a series of impinging air jets, which are formed by compressed air flowing through cooling passages in the dome. Once this cooling impingement cooling air is spent, it is then directed along the walls to augment the film cooling of the adjacent liner structure. However, the exit gaps at the edges of the baffles are typically not very well controlled, whereby utilization of the spent baffle cooling air for film cooling is not efficient and cannot be tailored to address identifiable hot spots. It will also be understood that this impingement cooling air is kept separate from combustion air mixed with fuel in the carburetor until the combustion chamber, at which point inhomgenieties with the fuel/air premixture occur resulting in increased emissions.

Accordingly, it would be desirable for a combustor dome assembly to be developed which overcomes the competing goals of lower emissions and combustor cooling caused by segregation of combustion and cooling air, especially one which may be utilized with either a single or multiple annular dome combustor.

SUMMARY OF THE INVENTION

In accordance with one aspect of the present invention, a dome assembly for a single annular combustor of a gas turbine engine is disclosed as having a first dome wall in flow communication with compressed air supplied to the combustor, the first dome wall including a central opening therein and at least one cooling passage therethrough. A baffle is spaced downstream of and connected to the first dome wall at radially outward and inward ends, the baffle also including a central opening therein. A second dome wall defining the central opening in the first dome wall is provided which extends upstream of the first dome wall. A venturi is located within the central opening of the first dome wall, with the venturi including a flange extending radially outward from the central opening, wherein the second dome wall is connected to the flange at an upstream end. A flare cone is located within the central opening of the baffle and radially outward of the venturi, wherein a substantially radial passage is provided between the venturi flange and the flare cone, the radial passage having a swirler located therein. Accordingly, a chamber is formed by the first dome wall, the second dome wall, the baffle, the venturi, and the flare cone, the chamber being in flow communication with the compressed air entering the combustor by means of the cooling passage in the first dome wall, whereby the compressed air impinges on the baffle, circulates in the chamber, and exits through the swirler. In addition, a circumferential row of cooling passages is preferably located in the baffle adjacent the flare cone and rows of cooling passages are also located at both the radially outward and inward ends of the baffle.

In accordance with a second aspect of the present invention, a dome assembly for a double annular combustor of a gas turbine engine is disclosed having a first dome wall in flow communication with compressed air supply to the combustor, the first dome wall including a central opening therein and at least one cooling passage therethrough. A first baffle is spaced downstream of and connected to the first dome wall at radially outward and inward ends, the first baffle also including a central opening therein. A second dome wall defining the central opening in the first dome wall is provided which extends upstream of the first dome wall. A first venturi is located within the central opening of the first dome wall, with the first venturi including a flange extending radially outward from the first dome wall central opening, wherein the second dome wall is connected to the first venturi flange at an upstream end. A third dome wall is provided which is in flow communication with compressed air supplied to the combustor, the third dome wall including a central opening therein and at least one cooling passage therethrough. A second baffle is spaced downstream of and connected to the third dome wall at radially outward and inward ends, the second baffle also including a central opening therein. A fourth dome wall defining the central opening in the third dome wall is provided which extends upstream of the third dome wall. A second venturi is located within the central opening of the third dome wall, with the second venturi including a flange extending radially outward from the third dome wall central opening, wherein the fourth dome wall is connected to the second venturi flange at an upstream end. A first flare cone is located within the central opening of the first baffle and radially outward of the first venturi, wherein a first substantially radial passage is provided between the first venturi flange and the first flare cone. A second flare cone is located within the central opening of the second baffle and radially outward of the second venturi, wherein a second substantially radial passage is provided between the second venturi flange and the second flare cone. A first swirler is located within the first radial passage and a second swirler is located within the second radial passage. Accordingly, a first chamber is formed by the first dome wall, the second dome wall, the first baffle, the first venturi, and the first flare cone and a second chamber is formed by the third dome wall, the fourth dome wall, the second baffle, the second venturi, and the second flare cone, each of the first and second chambers being in flow communication with the compressed air entering the combustor by means of the cooling passages in the first and third dome walls, whereby the compressed air impinges on the first and second baffles, circulates in the first and second chambers, and exits through the first and second swirlers.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
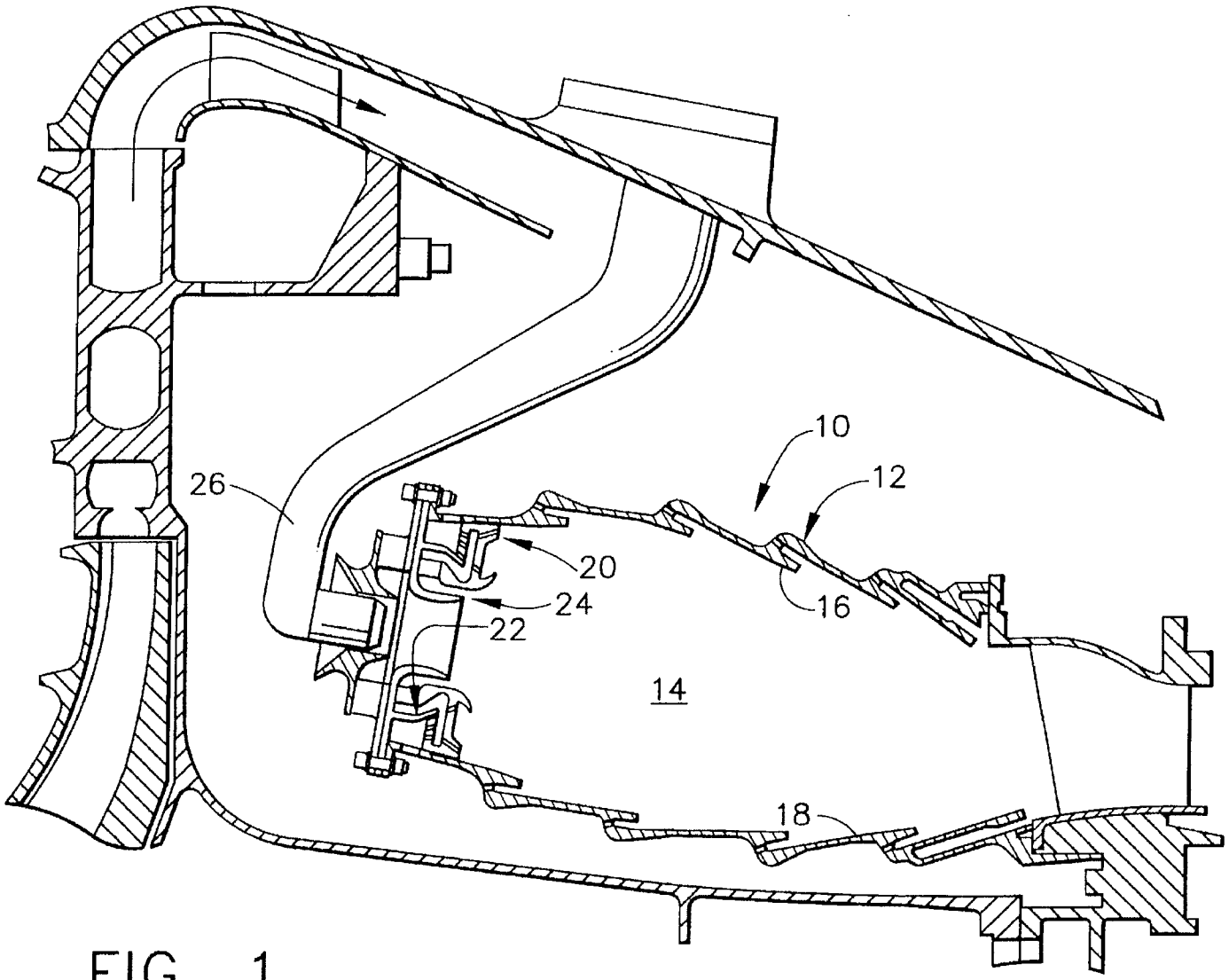
FIG. 1 is a cross-sectional view through a single annular combustor structure including a dome assembly of the present invention.

Referring now to the drawings in detail, wherein identical numerals indicate the same elements throughout the figures, FIG. 1 depicts a continuous burning combustion apparatus 10 of the type suitable for use in a gas turbine engine. Combustor 10 comprises a hollow body 12 defining a combustion chamber 14 therein. Hollow body 12 is generally annular in form and is comprised of an outer liner 16, an inner liner 18, and a domed end or dome 20. It should be understood, however, that this invention is not limited to such a radial flow annular configuration and may well be employed with equal effectiveness in combustion apparatus having an axial flow annular configuration, as well as the well known cylindrical can or cannular type. In the present annular configuration, dome 20 of hollow body 12 includes a plurality of circumferentially spaced openings 22 which each have disposed therein a carburetor 24 for the mixing of air and fuel prior to entry in combustion chamber 14. It is also seen that fuel is delivered to carburetor 24 by means of a hollow fuel tube 26 which is curved to fit within carburetor 24.

Figure 2:
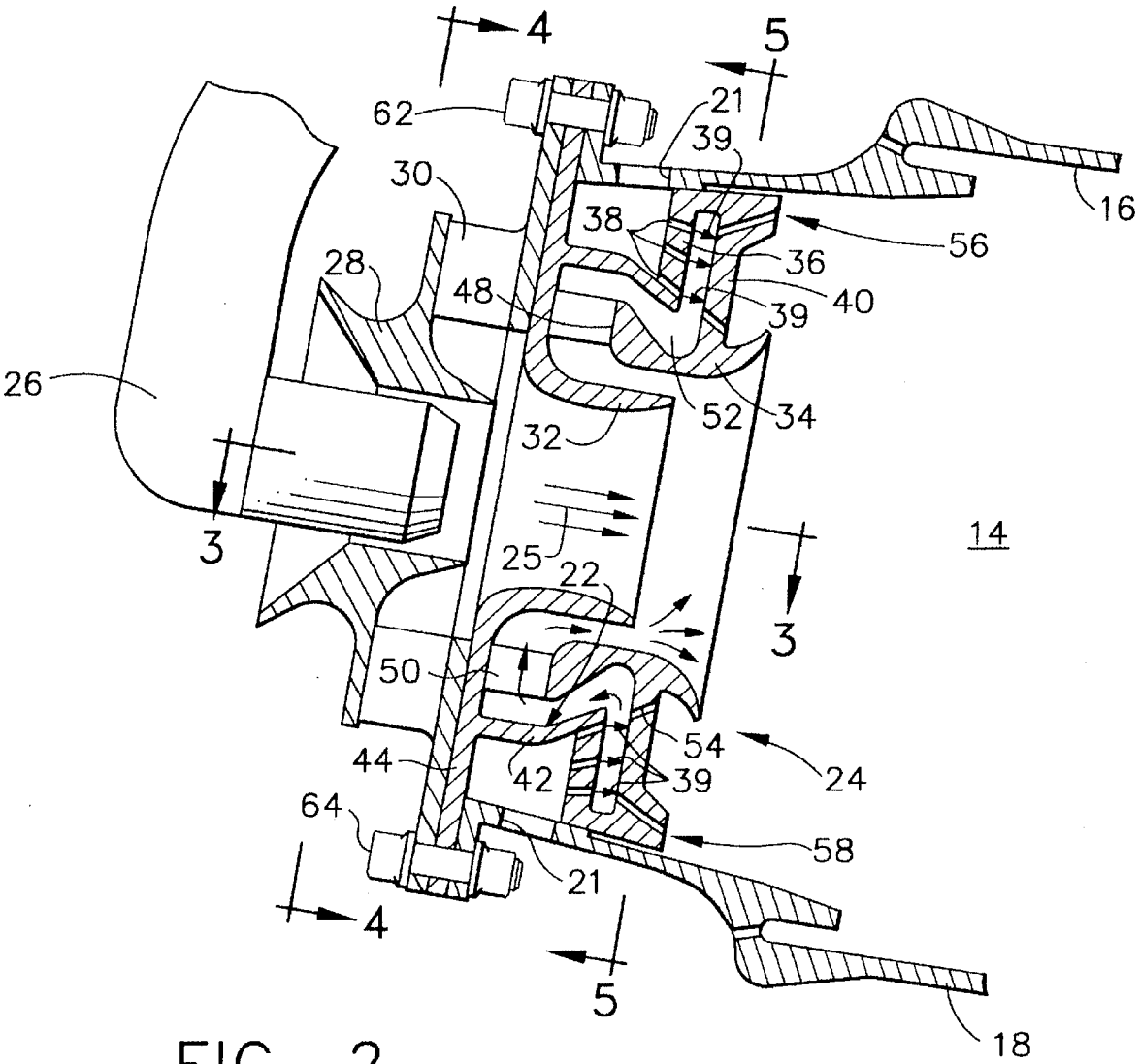
FIG. 2 is an enlarged, cross-sectional view of the dome assembly depicted in FIG. 1.

As best seen in FIG. 2, carburetor 24 includes an air blast disk 28, a primary swirler 30, a venturi 32, and a flare cone 34. With respect to dome assembly 20 of the present invention, it is seen that it is comprised of a plurality of modules designated generally by the numeral 60. More specifically, module 60 includes a first dome wall 36 which is in flow communication with compressed air supplied to combustor 10 at the inner and outer radial ends by means of holes 21 (see FIGS. 2 and 3) and spaces 67 between adjacent modules 60 and 60' (see FIG. 4), where first dome wall 36 preferably includes a plurality of cooling passages 38 therethrough. A baffle 40 is spaced downstream of and connected to first dome wall 36 at radially outward and inward ends, as well as at their cirfumferential ends, in order to protect first dome wall 36 from the radiant heat load produced within combustion chamber 14. It will be understood that cooling passages 38 in first dome wall 36 provide jets of impingement cooling air, depicted by arrows 39, on the upstream side of baffle 40.

Dome assembly module 60 further includes a second dome wall 42 which defines opening 22 in first dome wall 36. As seen in FIG. 2, second dome wall 42 extends upstream of first dome wall 36 and is connected to a flange 44 extending radially outward from venturi 32. Flare cone 34 is positioned within an opening in baffle 40 and is designed so that a substantially radial passage 48 is formed between venturi 32 and flare cone 34. Preferably, a secondary swirler 50 is positioned within radial passage 48 to produce a swirling action to the fuel/air mixing in carburetor 24, which may be either counter to or in the same direction as that imparted by primary swirler 30. Accordingly, it will be seen that a chamber 52 is formed by first dome wall 36, second dome wall 42, baffle 40, venturi 32, and flare cone 34.

It will be understood that chamber 52 is in flow communication with compressed air supplied through holes 21 by means of cooling passages 38 in first dome wall 36, whereby the compressed air circulates in chamber 52, impinges upon the upstream side of baffle 40, circulates in chamber 52, and exits through secondary swirler 50. Thus, rather than allowing impingement cooling air 39 to merely escape into combustion chamber 14, it is instead regenerated and utilized with the combustion air (depicted by arrows 25)in carburetor 24. This regenerated use of impingement cooling air 39 not only improves the level of emissions produced by combustor 10, whereby the trade-off between cooling and combustion air is partially eliminated to allow lean primary combustion zone, but also has the benefit of providing preheated air to carburetor 24. This preheated air effectively increases the combustor inlet temperature, which provides improved fuel evaporation, reduced emissions of CO and unburned hydrocarbons, and improved lean blow-out limits (which in turn allows use of leaner primary zones for reduced NOx).

Figure 5:
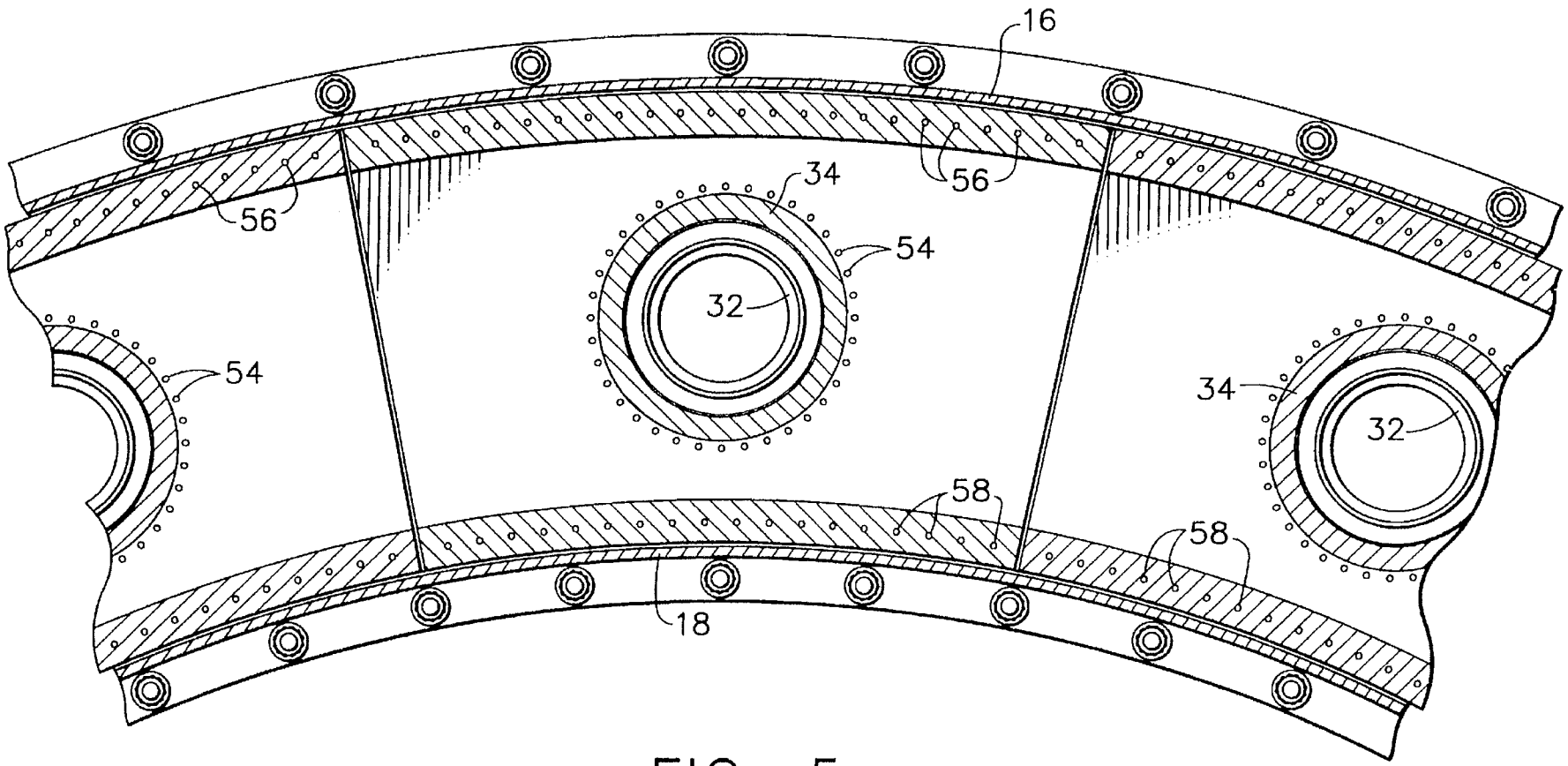
FIG. 5 is a partial, rear view of the dome assembly taken along line 5—5 in FIG. 2.

It will also be seen from FIGS. 2 and 5 that a circumferential row of passages 54 are preferably provided within baffle 40 adjacent flare cone 34 in order to provide cooling thereof. Likewise, rows of cooling passages 56 and 58 may be provided at the radially inward and outward ends, respectively, of baffle 40 to provide film cooling of outer and inner liners 16 and 18. Even if cooling passages 56 and 58 are provided in baffle 40, it is preferred that at least half of the impingement cooling air 39 entering chamber 52 flow through secondary swirler 50 as depicted in FIG. 2. Accordingly, it is preferred that the remaining portion of impingement cooling air 39 entering chamber 52 be divided approximately equally between cooling passages 54, 56 and 58.

Further, it is preferred that module 60 be an integral structure comprised of first dome wall 36, second dome wall 42, baffle 40, venturi 32, and flare cone 34. As such, module 60 may be made from precision investment castings which allow the use of higher temperature materials, such as those used in turbine engines. Use of these type of castings has the further benefit of controlling the size and orientation of cooling passages 39, 54, 56 and 58 so as to maximize their effect with respect to hot areas (and thereby reduce the amount of air required). It will be recognized that module 60 (through venturi flange 44) is connected at the radially outward end to outer liner 16 and at the radially inward end to inner liner 18 by means of bolted connections 62 and 64, respectively.

Figure 3:
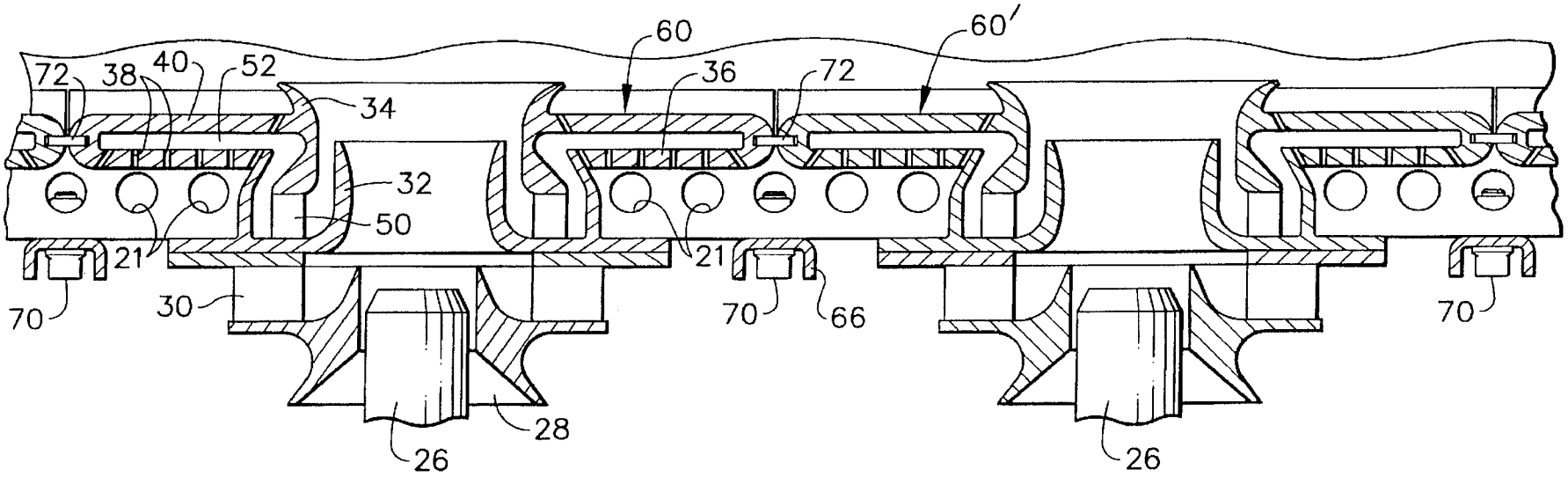
FIG. 3 is a partial, circumferential view of the dome assembly taken along lines 3—3 in FIG. 2.
Figure 4:
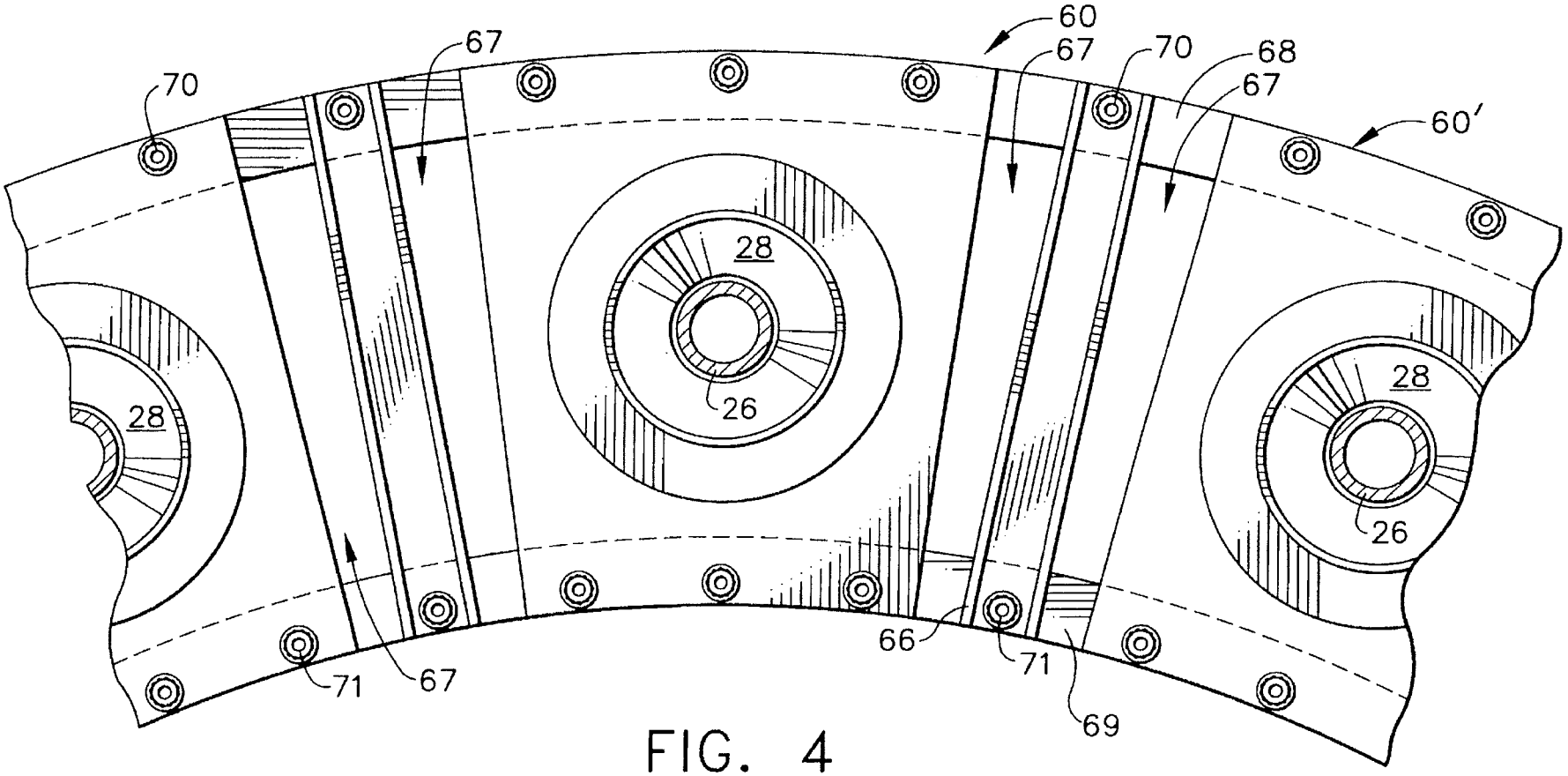
FIG. 4 is a partial, front view of the dome assembly taken along line 4—4 in FIG. 2.

As best seen in FIGS. 3 and 4, adjacent modules 60 and 60' are connected circumferentially at the upstream side by means of a connecting member 66.

Connecting member 66 preferably is U-shaped and is connected to flanges 68 and 69 on inner and outer liners 16 and 18, respectively, by means of bolted connections 70 and 71. At the downstream end of modules 60 and 60', it is seen that modules 60 and 60' are attached by means of a sealing strip 72 like those well known in the turbine art.

Figure 6:
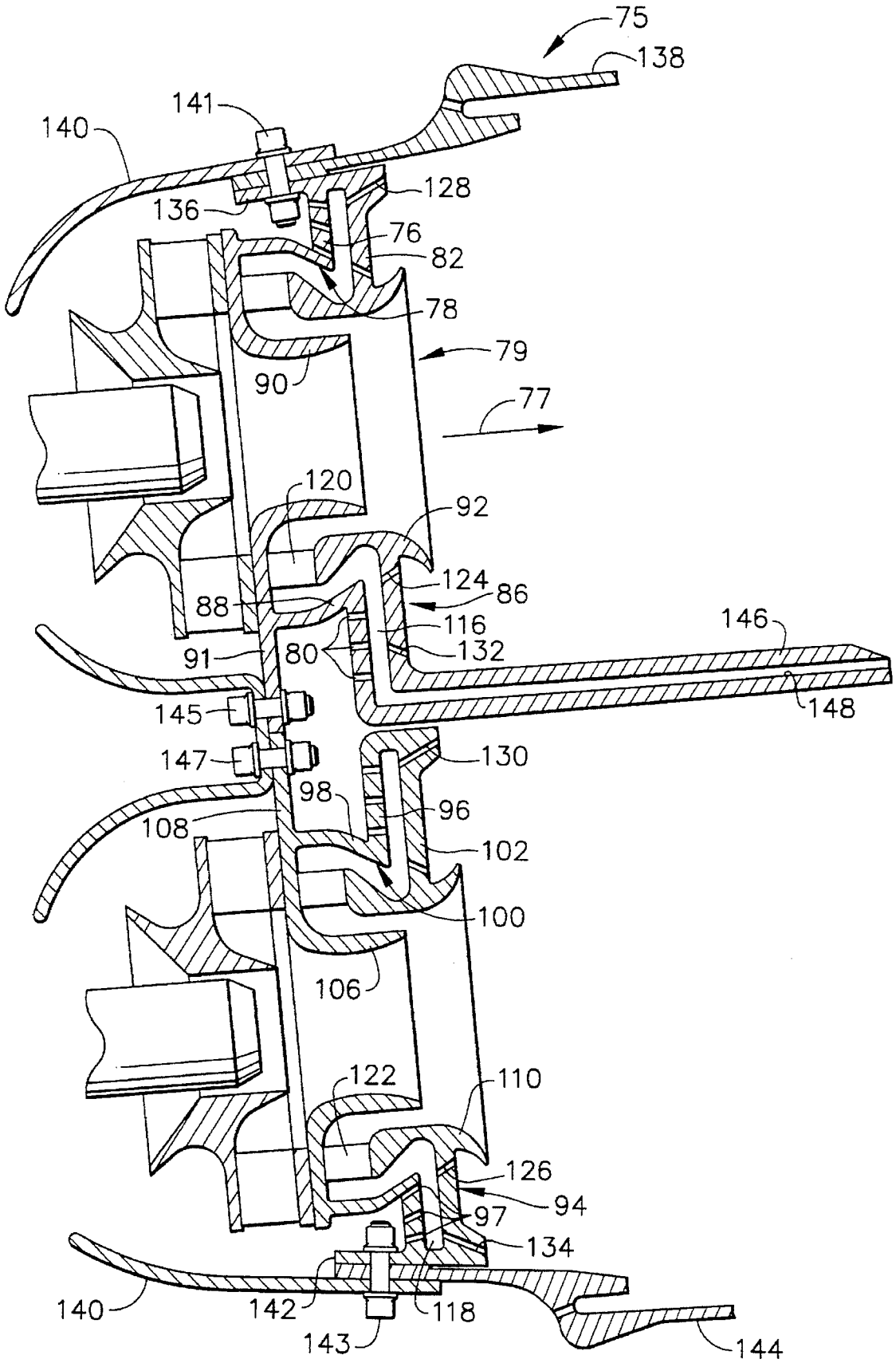
FIG. 6 is a cross-sectional view through a double annular combustor structure including a second embodiment of the dome assembly of the present invention.

While FIGS. 1–5 depict dome assembly 20 of the present invention being utilized in a single annular combustor 10, it will be understood that a similar dome assembly may be utilized with a double annular combustor as depicted in FIG. 6. As seen therein, double annular combustor 75 generally has a configuration similar to that depicted in U.S. Pat. No. 5,197,289 to Glevicky et al. In order to implement the module-type dome assembly of the present invention to double annular combustor 75, separate modules 86 and 94 are provided at the radially outward and inward ends, respectively. Radially outward module 86 includes a first dome wall 76 which is in flow communication with compressed air supplied to combustor 75, first dome wall 76 including a central opening 78 therein and a plurality of cooling passages 80 therethrough. A first baffle 82 is spaced downstream of and connected to first dome wall 76 at radially outward and inward ends with respect to an axis 77 through outer carburetor 79, with first baffle 82 also including a central opening therein which is aligned with opening 78. As described hereinabove with regard to module 60, module 86 is constructed of first dome wall 76, first baffle 82, a second dome wall 88, a first venturi 90 located within opening 78, and a first flare cone 92 located within the opening in first baffle 82.

Likewise, a radially inward module 94 is provided which is constructed of a third dome wall 96 which is in flow communication with compressed air supplied to combustor 75, a fourth dome wall 98 defining a central opening 100 within third dome wall 96, a second baffle 102 spaced downstream of and connected to third dome wall 96 at radially outward and inward ends, second baffle 102 including an opening in alignment with opening 100, a second venturi 106 located within opening 100 in third dome wall 96, with fourth dome wall 98 being connected at an upstream end to a second venturi flange 108, and a second flare cone 110 located within the opening in second baffle 102, wherein a second substantially radial passage 112 is provided between second venturi flange 108 and second flare cone 110.

In this construction, both modules 86 and 94 are constructed so that chambers 116 and 118, respectively, defined thereby are in flow communication with compressed air supplied to combustor 75. In this way, the compressed air enters chambers 116 and 188 by means of cooling passages 80 and 97 in first and third dome walls 76 and 96, respectively. Thereafter, the air impinges upon the upstream surface of first and second baffles 82 and 102, circulates in chambers 116 and 118, and exits through a first secondary swirler 120 and a second secondary swirler 122.

Similar to dome module 60 described above, first and second baffles 82 and 102 each include at least one cooling passage therethrough. Preferably, first baffle 82 includes a circumferential row of cooling passages 124 located adjacent first flare cone 92 and second baffle 102 includes a circumferential row of cooling passages 126 located adjacent second flare cone 110. Further, first and second baffles 82 and 102 preferably include a row of cooling passages 128 and 130 at their respective radially outward ends and a row of cooling passages 132 and 134 at their respective radially inward ends.

It will be seen from FIG. 6 that double annular combustor 75 has an axial flow. Accordingly, module 86 includes a fifth dome wall 136 adjacent the radially outward end of first dome wall 76 which extends upstream therefrom and connects module 86 to an outer liner 138 of combustor 75, as well as a radially outward end of a cowl 140 by means of a bolted connection 141. Correspondingly, a sixth dome wall 142 is located adjacent a radially inward end of third dome wall 96 and extends upstream therefrom, whereby sixth dome wall 142 is connected to an inner liner 144 and a radially inward end of cowl 140 by means of a bolted connection 143. Cowl 140 is also connected to modules 86 and 94 at a mid portion, and specifically to first venturi flange 91 by a bolted connection 145 and second venturi flange 108 by a bolted connection 147.

Also unique to double annular combustor 75 is the implementation of a centerbody 146 with either module 86 or 94. FIG. 6 depicts centerbody 146 as being integral with module 86, and specifically with first dome wall 76 and first baffle 82 at the radially inward end thereof. In this way, chamber 116 is extended through centerbody 146 so as to provide a passage to allow air to escape centerbody 146. Nevertheless, it will be understood that the impingement cooling air entering chamber 116 through cooling passages 80 will flow primarily through first secondary swirler 120 and thereafter be split between passages 124, 128, 132, and passage 148 through centerbody 146.

Having shown and described the preferred embodiment of the present invention, further adaptations of the dome assembly described herein can be accomplished by appropriate modifications by one of ordinary skill in the art without departing from the scope of the invention. In particular, it will be understood that attachment of the modules is dependent on the surrounding hardware (i.e., whether a cowl is provided or not). Additionally, the cooling of the baffles herein may be augmented by means of pin banks or other turbulated surface arrangements on the upstream side thereof. Moreover, while only the secondary swirlers of the carburetor are shown as being a part of the modules, it is possible that the primary swirler could also be implemented within the modules if packaging limitations permit. Although the dome assembly embodiments described herein are shown in conjunction with a conventional film cooled liner structure, they may also be utilized with regenerative or dilution flow impingement cooled liners or with liners having conventional multi-hole cooling or shingled/floatwall construction.

What is claimed is:

1. A dome assembly for a single annular combustor of a gas turbine engine comprising a plurality of modules, each of said modules further comprising:

(a) a first dome wall in flow communication with compressed air supplied to said combustor, said first dome wall including a central opening therein and at least one cooling passage therethrough;

(b) a baffle spaced downstream of and connected to said first dome wall at radially outward and inward ends, said baffle including a central opening therein;

(c) a second dome wall defining said central opening in said first dome wall, said second dome wall extending upstream of said first dome wall;

(d) a venturi located within said central opening of said first dome wall, said venturi including a flange extending radially outward from said central opening, wherein said second dome wall is connected to said flange at an upstream end;

(e) a flare cone located within said central opening of said baffle and radially outward of said venturi, wherein a substantially radial passage is provided between said venturi flange and said flare cone; and (f) a swirler located within said radial passage;

wherein a chamber is formed by said first dome wall, said second dome wall, said baffle, said venturi, and said flare cone, said chamber being in flow communication with said compressed air by means of said cooling passage in said first dome wall, whereby said compressed air impinges on said baffle and circulates through said swirler.

2. The dome assembly of claim 1, said baffle including at least one cooling passage therethrough.

3. The dome assembly of claim 2, wherein a circumferential row of said cooling passages is located adjacent said flare cone.

4. The dome assembly of claim 2, wherein said cooling passages are located at both the radially outward and inward ends of said baffle.

5. The dome assembly of claim 2, wherein at least half of said compressed air entering said chamber flows through said swirler.

6. The dome assembly of claim 1, wherein said venturi flange connects said dome assembly to an inner liner at a radially inward end and to an outer liner at a radially outward end.

7. The dome assembly of claim 1, wherein said first dome wall, said second dome wall, said baffle, said venturi, and said flare cone is an integral structure.

8. The dome assembly of claim 7, wherein said integral structure is made from a casting.

9. The dome assembly of claim 6, further comprising a member for connecting adjacent modules circumferentially.

10. The dome assembly of claim 9, said connecting member being attached to said venturi flange of adjacent modules, wherein a seal is formed to prevent air from flowing therebetween.

11. The dome assembly of claim 1, wherein said swirler is a secondary swirler.

12. The dome assembly of claim 1, wherein said swirler is a primary and a secondary swirler.

13. A dome assembly for a double annular combustor of a gas turbine engine, comprising:

(a) a plurality of radially outward modules, each of said radially outward modules further comprising:

(i) a first dome wall in flow communication with compressed air supplied to said combustor, said first dome wall including a central opening therein and at least one cooling passage therethrough;

(ii) a first baffle spaced downstream of and connected to said first dome wall at radially outward and inward ends, said first baffle including a central opening therein;

(iii) a second dome wall defining said central opening in said first dome wall, said second dome wall extending upstream of said first dome wall;

(iv) a first venturi located within said central opening in said first dome wall, said first venturi including a flange extending radially outward from said first dome wall central opening, wherein said second dome wall is connected to said first venturi flange at an upstream end;

(v) a first flare cone located within said central opening in said first baffle and radially outward of said first venturi, wherein a first substantially radial passage is provided between said first venturi flange and said first flare cone;

(vi) a first swirler located within said first radial passage; and (b) a plurality of radially inward modules, each of said radially inward modules further comprising:

(i) a third dome wall in flow communication with compressed air supplied to said combustor, said third dome wall including a central opening therein and at least one cooling passage therethrough;

(ii) a second baffle spaced downstream of and connected to said third dome wall at radially outward and inward ends, said second baffle including a central opening therein;

(iii) a fourth dome wall defining said central opening in said third dome wall, said fourth dome wall extending upstream of said third dome wall;

(iv) a second venturi located within said central opening in said third dome wall, said second venturi including a flange extending radially outward from said third dome wall central opening, wherein said fourth dome wall is connected to said second venturi flange at an upstream end;

(v) a second flare cone located within said central opening in said second baffle and radially outward of said second venturi, wherein a second substantially radial passage is provided between said second venturi flange and said second flare cone;

(vi) a second swirler located within said second radial passage;

wherein a first chamber is formed in said radially outward module by said first dome wall, said second dome wall, said first baffle, said first venturi, and said first flare cone and a second chamber is formed in said radially inward module by said third dome wall, said fourth dome wall, said second baffle, said second venturi, and said second flare cone, each of said first and second chambers being in flow communication with said compressed air by means of said cooling passages in said first and third dome walls, whereby said compressed air impinges on said first and second baffles, circulates in said first and second chambers, and exits through said first and second swirlers.

14. The dome assembly of claim 13, said first and second baffles each including at least one cooling passage therethrough.

15. The dome assembly of claim 14, said first baffle including a circumferential row of said cooling passages located adjacent said first flare cone and said second baffle including a circumferential row of said cooling passages located adjacent said second flare cone.

16. The dome assembly of claim 14, said first and second baffles each including a row of cooling passages located at both the radially outward and inward ends of said baffles.

17. The dome assembly of claim 13, further comprising:

(a) a fifth dome wall adjacent a radially outward end of said first dome wall extending upstream therefrom, said fifth dome wall being connected to an outer liner of said combustor;

(b) a sixth dome wall adjacent a radially inward end of said third dome wall extending upstream therefrom, said sixth dome wall being connected to an inner liner of said combustor.

18. The dome assembly of claim 17, further comprising a cowl upstream of said dome assembly, said cowl being connected at a radially outward end to said fifth dome wall and said outer liner and at a radially inward end to said sixth dome wall and said inner liner.

19. The dome assembly of claim 18, said cowl being connected at a mid portion to said first venturi flange and said second venturi flange.

20. The dome assembly of claim 13, further comprising a centerbody extending downstream between said first and second flare cones, said centerbody being integrally attached to one of said radially outward and radially inward modules.

* * * * *